US010196870B2

(12) United States Patent
Eldho et al.

(10) Patent No.: US 10,196,870 B2
(45) Date of Patent: Feb. 5, 2019

(54) EXTERNAL SLIP HAVING EXPANDABLE SLOTS AND A RETAINER

(71) Applicant: Halliburton Energy Services, Inc., Houston, TX (US)

(72) Inventors: Shanu Thottungal Eldho, Singapore (SG); Michael Dale Ezell, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 241 days.

(21) Appl. No.: 15/030,255

(22) PCT Filed: Nov. 29, 2013

(86) PCT No.: PCT/US2013/072483
§ 371 (c)(1),
(2) Date: Apr. 18, 2016

(87) PCT Pub. No.: WO2015/080751
PCT Pub. Date: Jun. 4, 2015

(65) Prior Publication Data
US 2016/0251922 A1 Sep. 1, 2016

(51) Int. Cl.
*E21B 23/01* (2006.01)
*E21B 33/129* (2006.01)

(52) U.S. Cl.
CPC ..... *E21B 23/01* (2013.01); *E21B 33/129* (2013.01); *E21B 33/1292* (2013.01)

(58) Field of Classification Search
CPC .... E21B 33/01; E21B 33/1292; E21B 33/129; E21B 23/01
See application file for complete search history.

(56) References Cited

U.S. PATENT DOCUMENTS 4,438,811 A 3/1984 Patel
5,906,240 A * 5/1999 Kilgore ..... E21B 23/01 166/206

(Continued)

FOREIGN PATENT DOCUMENTS

EP 0898048 B1 2/1999

OTHER PUBLICATIONS

SG Written Opinion issued in corresponding application No. 29/11/2013 dated Apr. 14, 2016, 7 pgs.

(Continued)

*Primary Examiner* — Robert E Fuller
(74) *Attorney, Agent, or Firm* — Chamberlain Hrdlicka

(57) ABSTRACT

An external slip includes a slip body comprising a wall having internal and external surfaces. The internal surface includes a ramp portion, and a plurality of teeth is disposed on the external surface of the wall of the slip body. A plurality of expansion slots extends through a thickness of the wall, at least one extending from a first end of the wall toward a second end of the wall but not reaching the second end. At least another of the plurality of expansion slots extends from the second end toward the first end of the wall but does not reach the first end. An installation slot extends through a thickness of the wall along a length of the wall, and a retainer is coupled to first and second gap ends of the wall across a gap created by the installation slot.

18 Claims, 5 Drawing Sheets

(56) References Cited

U.S. PATENT DOCUMENTS

| | | | | |
|---|---|---|---|---|
| 6,302,217 | B1 | 10/2001 | Kilgore et al. | |
| 6,378,606 | B1 | 4/2002 | Swor et al. | |
| 2005/0189120 | A1 | 9/2005 | Doane et al. | |
| 2010/0012330 | A1* | 1/2010 | Ezell | E21B 33/1285 166/387 |
| 2010/0139911 | A1 | 6/2010 | Stout | |
| 2012/0160522 | A1 | 6/2012 | Burgos | |

OTHER PUBLICATIONS

International Search Report dated Aug. 28, 2014, issued in corresponding application No. PCT/US2013/072483, 3 pgs.

* cited by examiner

EXTERNAL SLIP HAVING EXPANDABLE SLOTS AND A RETAINER

BACKGROUND

1. Field

The present disclosure relates generally to external slips, packer assemblies, and related methods, usable in a well accessing a subterranean formation.

2. Description of Related Art

Wells are drilled at various depths to access and produce oil, gas, minerals, and other naturally-occurring deposits from subterranean geological formations. Hydrocarbons may be produced through a wellbore traversing the subterranean formations. Prior to and during completion of a well, packer assemblies may be used in the wellbore to separate the wellbore into one or more zones. A packer assembly is typically used to provide a seal between the outside of a production tubing string and the inside of a casing, liner, or wellbore wall. The seal may be provided by a packer element and a slip is responsible for retaining the packer assembly in position by gripping the casing, liner, wellbore wall, or other surface against which the packer is intended to seal.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION OF ILLUSTRATIVE EMBODIMENTS

Figure 1:
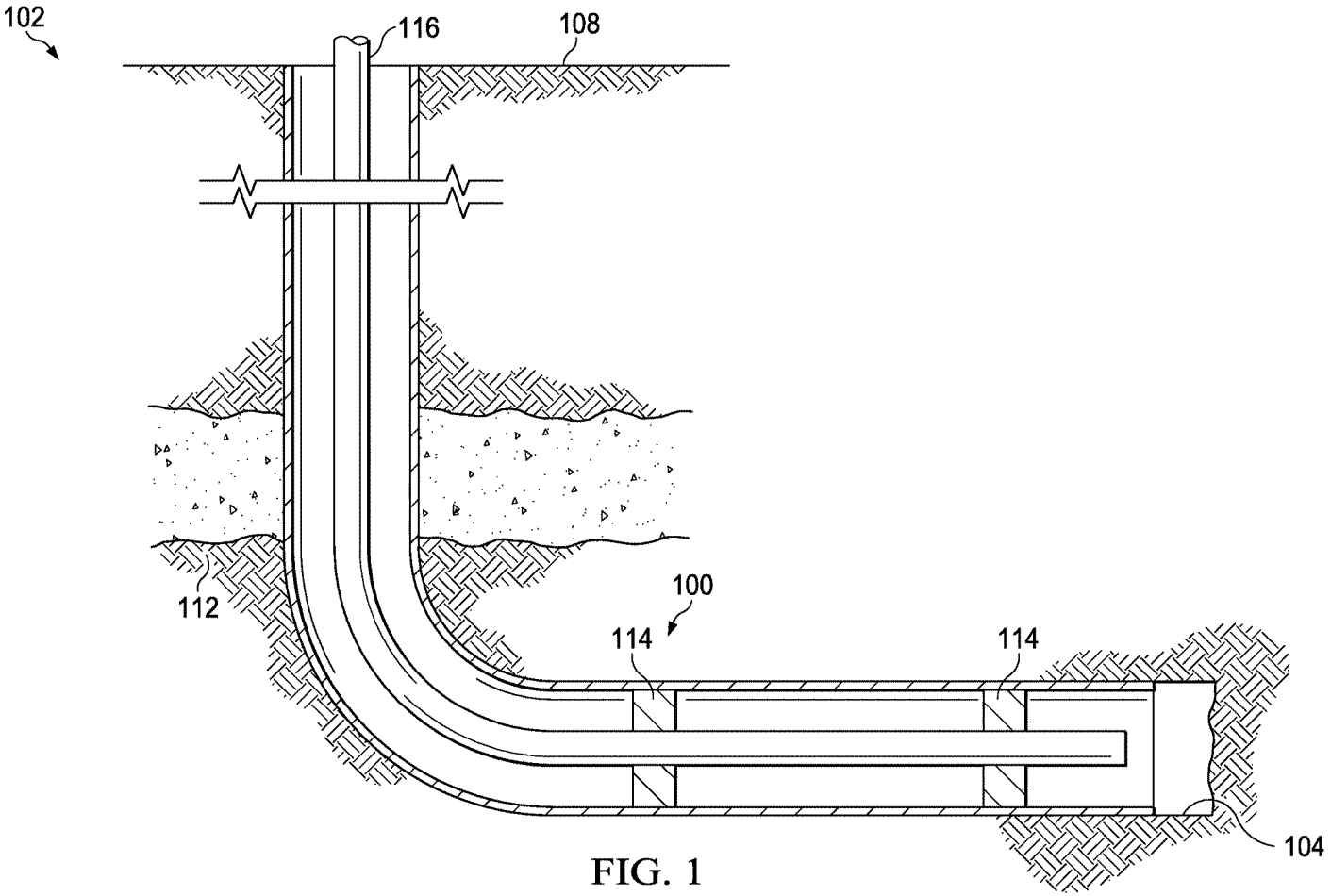
FIG. 1 illustrates a schematic view of a well in which an illustrative embodiment of a packer assembly and external slip is deployed.

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to". Unless otherwise indicated, as used throughout this document, "or" does not require mutual exclusivity.

As used herein, the phrases "hydraulically coupled," "hydraulically connected," "in hydraulic communication," "fluidly coupled," "fluidly connected," and "in fluid communication" refer to a form of coupling, connection, or communication related to fluids, and the corresponding flows or pressures associated with these fluids. In some embodiments, a hydraulic coupling, connection, or communication between two components describes components that are associated in such a way that fluid pressure may be transmitted between or among the components. Reference to a fluid coupling, connection, or communication between two components describes components that are associated in such a way that a fluid can flow between or among the components. Hydraulically coupled, connected, or communicating components may include certain arrangements where fluid does not flow between the components, but fluid pressure may nonetheless be transmitted such as via a diaphragm or piston.

The present disclosure relates generally to a packer assembly and external slip that provide the improved grip of a barrel-style slip with the ease of installation of a C-style casing slip. Unlike the C-style casing slip, the slip described herein is capable of being set in a well without breaking into multiple segments. The slip and packer assembly may then later be retrieved from the well without destroying the packer assembly and slip. The slip described herein also varies from the barrel-style slip in that it allows easier installation of the slip into engagement with the wedge of a packer.

Referring now to FIG. 1, a packer assembly 100 according to an illustrative embodiment is used in a well 102 having a wellbore 104 that extends from a surface 108 of the well to or through a subterranean geological formation 112. The well 102 is illustrated onshore in FIG. 1, but the well could alternatively be an offshore well accessed by a floating or fixed platform. The packer assembly 100 includes one or more external slips 114, or casing slips, that assist in setting the packer assembly 100 in the well. The packer assembly 100 and external slips 114 may be deployed in the well during or after production tubing 116 is run into the well 102. Alternatively, the packer assembly 100 may be deployed using other techniques.

Figure 2:
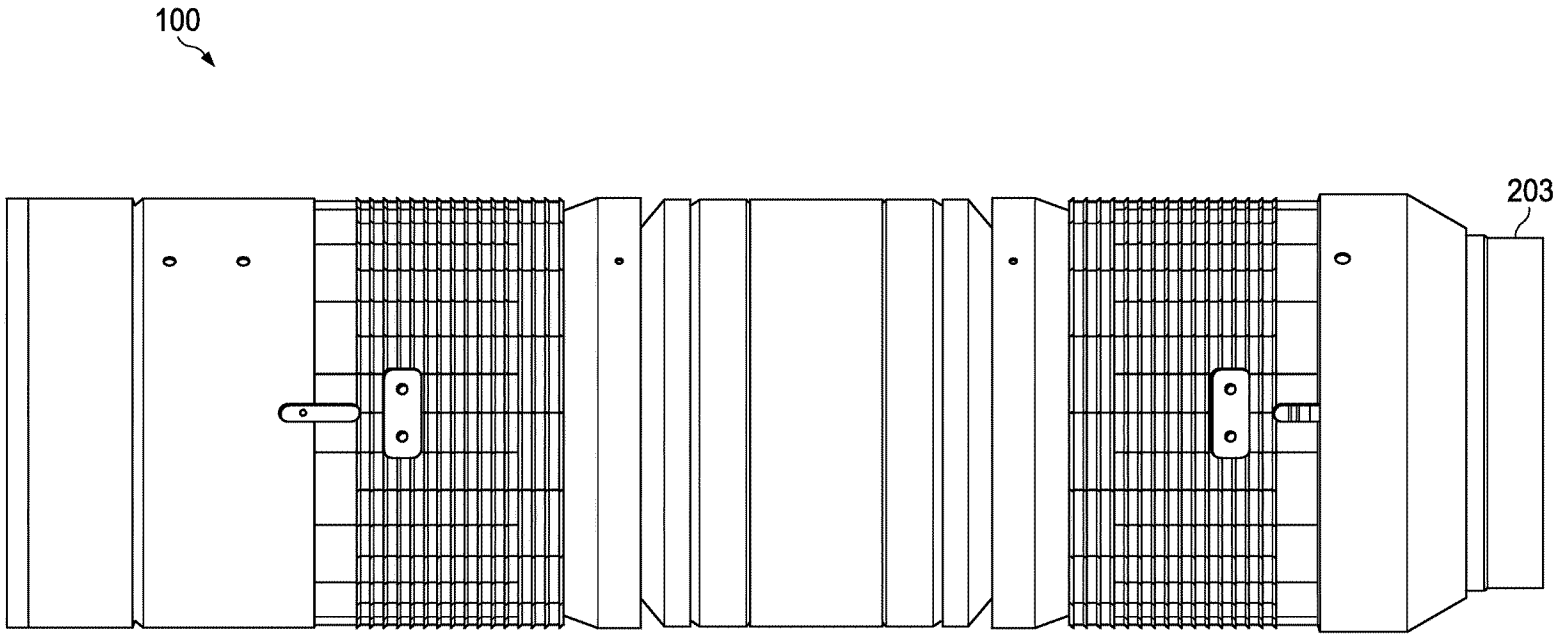
FIG. 2 depicts a front view of the packer assembly and external slip of FIG. 1.
Figure 3:
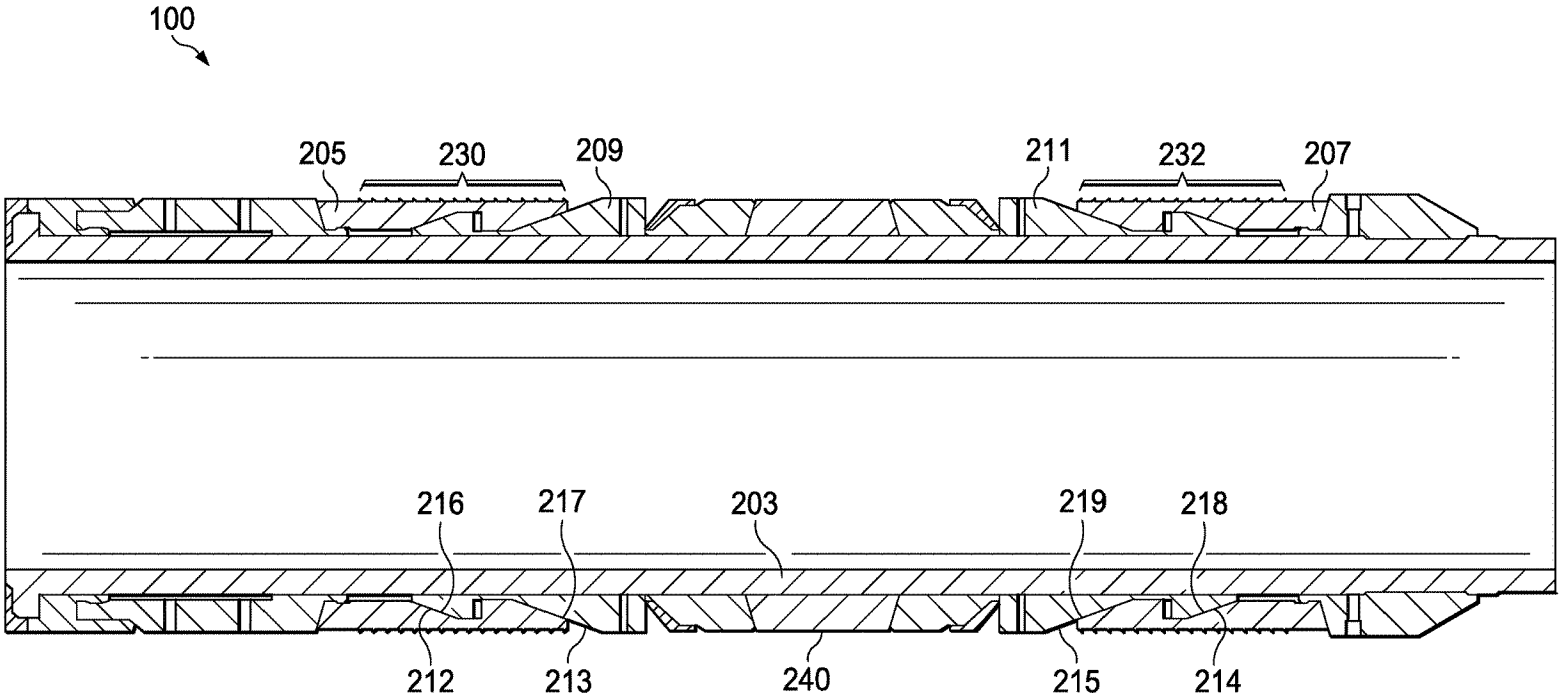
FIG. 3 illustrates a cross sectional front view of the packer assembly and external slip of FIG. 1.

Referring now to FIGS. 2 and 3, front and front cross-sectional views, respectively, of the packer assembly 100 are illustrated. In some embodiments, the packer assembly 100 may include a mandrel 203 that is connected to or received on a production tubing string extending from the surface of the well. As is typical of most opposing slip packer assemblies, the mandrel 203 may support an upper, or first external slip 205 and a lower, or second casing slip 207. Each casing slip 205, 207 may be adjacent a wedge 209, 211 that is slidably received on the mandrel 203. The wedges 209, 211 are capable of sliding between the casing slips 205, 207 and the mandrel 203 as the packer assembly 100 is deployed or "set" downhole. Each of the wedges 209, 211 may each include a ramped surface 213, 215. In the embodiment illustrated in FIG. 3, the wedges 209, 211 may also include ramped surfaces 212, 214. The packer assembly 100 is capable of being placed in a set position in which the ramped surfaces 212, 213, 214, 215 of the wedges 209, 211 engage complimentary ramped surfaces 216, 217, 218, 219 on the slips 205, 207. In the set position, the wedges 209, 211, through the ramped surfaces 212, 213, 214, 215, exert a force in the direction of the respective casing slip 205, 207, which results in each slip 205, 207 expanding radially outward. A plurality of teeth 230, 232 disposed on each of the slips 205, 207 are capable of engaging an inner surface of a casing, or alternatively a liner, an uncased wellbore wall, or another surface when the packer assembly is placed in the set position.

The packer assembly 100 also includes an expandable element 240 slidingly disposed on the mandrel 203. With the packer assembly 100 in the set position, the expandable element 240 is subjected to compression forces that cause the expandable element 240 to expand radially outward, thereby providing a fluid seal between the mandrel 203 and the casing, liner, or wellbore. This compressive force within the packer assembly 100 is retained by the slips 205, 207, which prevent the compressive force within the packer assembly 100 from releasing.

Figure 4A:
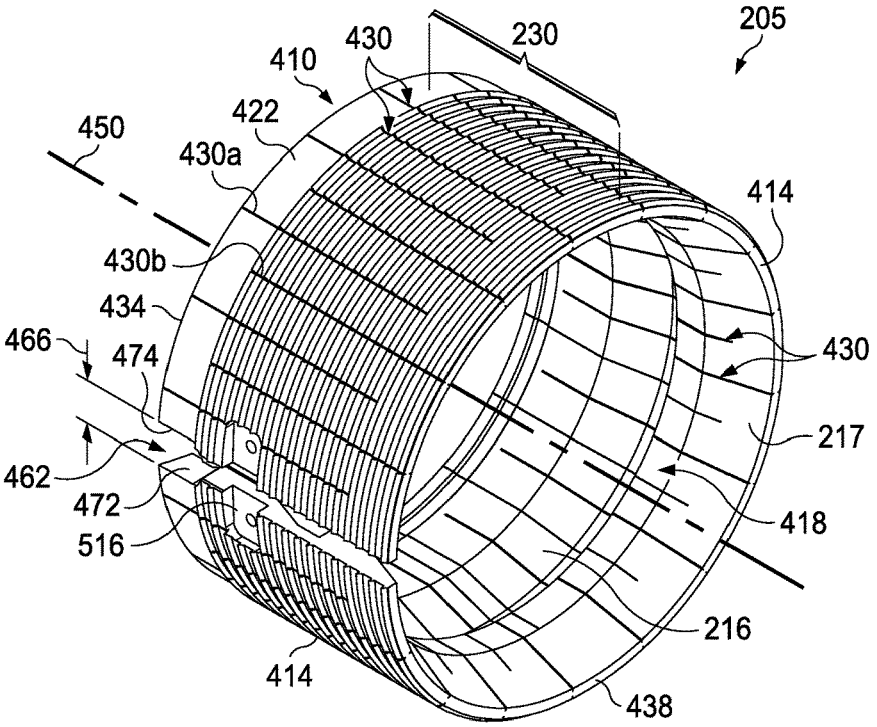
FIG. 4A depicts an isometric view of the external slip of FIG. 2, the external slip illustrated in an expanded installation position.
Figure 4B:
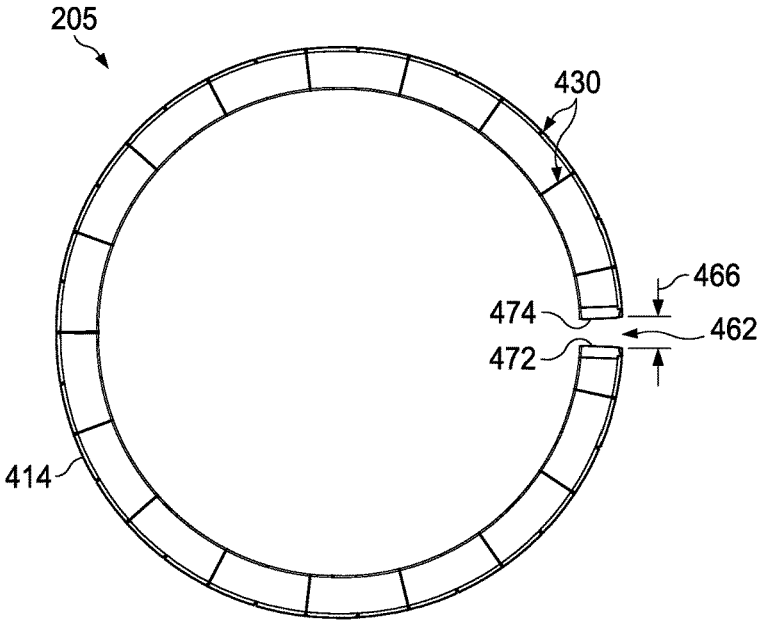
FIG. 4B illustrates a side view of the external slip of FIG. 4A.

Referring to FIGS. 4A and 4B, isometric and side views, respectively, of the external slip 205 is illustrated in an expanded installation position. The expanded installation position of the external slip 205 occurs prior to and during installation of the external slip 205 on the mandrel 203 of the packer assembly 100. The external slip 205 also includes a pre-set position, in which the external slip 205 is positioned on the mandrel 203 but has not yet been "set" in the wall with packer assembly 100, and a set position, which corresponds to the position of the external slip 205 when the packer assembly is in its set position.

Referring still to FIGS. 4A and 4B, the external slip 205 may include a slip body 410 having a wall 414 that may have a substantially cylindrical shape as illustrated in FIGS. 4A and 4B. In other embodiments, the shape formed by the wall 414 may be other shapes that are not substantially cylindrical. The wall 414 includes an internal surface 418 and an external surface 422, the internal surface 418 having the ramped portions or surfaces 216, 217 that are capable of engaging the corresponding or complimentary surfaces 212, 213 of wedge 209. The plurality of teeth 230 is disposed on the external surface 422 of the wall 414 of the slip body 410.

The slip body 410 may include a plurality of expansion slots 430 extending through a thickness of the wall 414. In some embodiments, at least one 430*a* of the plurality of expansion slots 430 extends from a first end 434 of the wall 414 toward a second end 438 of the wall 414 but does not reach the second end 438 of the wall 414. In other words, this particular expansion slot 430*a*, while passing through the entire thickness of the wall 414, does not run the entire length of the wall 414 from the first end 434 to the second end 438. Instead, the expansion slot 430*a* stops short of the second end 438. Another expansion slot 430*b* of the plurality of expansion slots 430 extends from the second end 438 of the wall 414 toward the first end 434 of the wall 414 but does not reach the first end 434 of the wall 414. In other words, this particular expansion slot 430*b*, while passing through the entire thickness of the wall 414, does not run the entire length of the wall 414 from the second end 438 to the first end 434. Instead, the expansion slot 430*b* stops short of the first end 434.

The positioning of the plurality of expansion slots 430 may vary. In some embodiments, the expansion slots 430 may be disposed in the wall 414 such that some or all of the expansion slots 430 are substantially parallel to one another. As illustrated in FIG. 4A, one or more of the expansion slots may also be arranged parallel to a longitudinal axis 450 of the slip body 410. In other embodiments, the arrangement of the expansion slots 430 may be such that some of the expansion slots 430 are not parallel to others or to the longitudinal axis 450.

In FIGS. 4A and 4B, the expansion slots 430 are each of equal length, and the plurality of expansion slots 430 are circumferentially and evenly spaced about the slip body 410. In other embodiments, the expansion slots 430 may vary in length from one another and may be spaced apart unequally, or in other particular patterns. As illustrated in FIG. 4A, the disposition of the plurality of expansion slots 430 may be such that any two adjacent expansion slots (for example expansion slots 430*a*, 430*b*) may extend into the wall 414 from opposing ends 434, 438 of the wall. In other words, the expansion slots 430 alternate such that any adjacent expansion slots 430 do not extend from a same end of the first and second ends 434, 438. In some embodiments, however, it may be desirable to employ other configurations, such as for example, a configuration where pairs of adjacent expansion slots 430 extend from one of the same ends 434, 438, and other pairs extend from the other of the same ends 434, 438. Other configurations may also be possible, including configurations in which each expansion slot 430 is not a continuous slot, but rather a combination of two or more slots linearly aligned.

The slip body 410 may also include an installation slot 462 extending through a thickness of the wall 414 along a length of the wall 414 from the first end 434 to the second end 438. The installation slot 462 defines a gap 466 that is larger when the external slip 205 is in the expanded installation position illustrated in FIGS. 4A and 4B. The gap 466 is bounded on either side by first and second gap ends 472, 474 of the wall 414. In the expanded installation position, the external slip 205 may be installed on the mandrel 203 and it is easier to properly position the wedge 209 such that the multiple ramped surfaces 212, 213 of the wedge 209 engage the multiple ramped surfaces 216, 216 of the external slip 205.

Figure 5A:
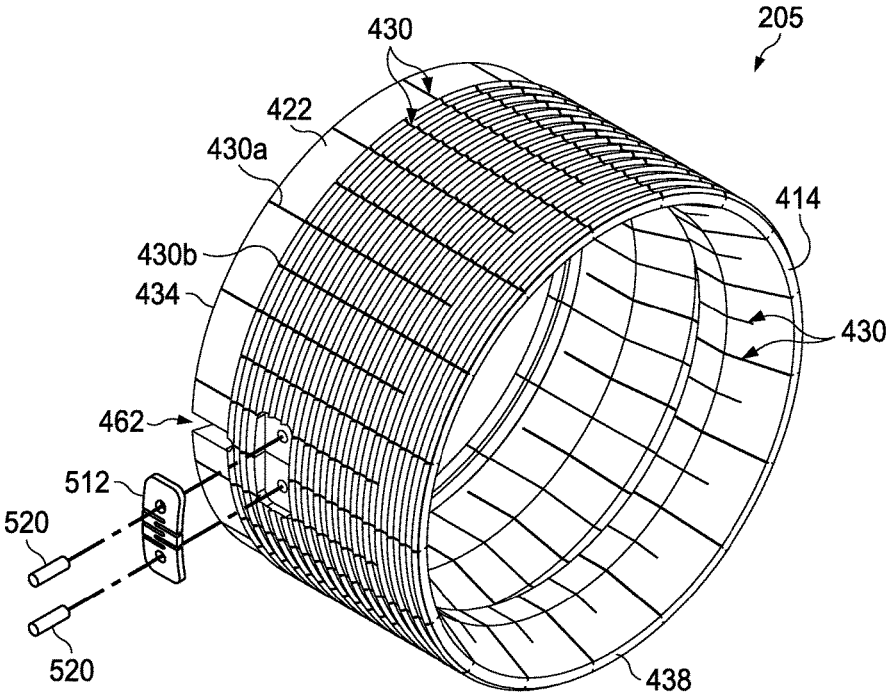
FIG. 5A depicts an isometric view of the external slip of FIG. 2, the external slip illustrated in a pre-set position.
Figure 5B:
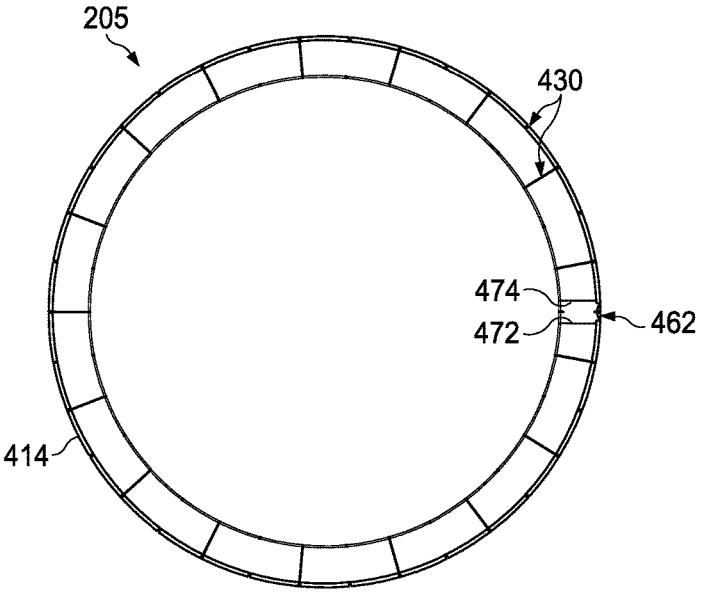
FIG. 5B illustrates a side view of the external slip of FIG. 5A.
Figure 5C:
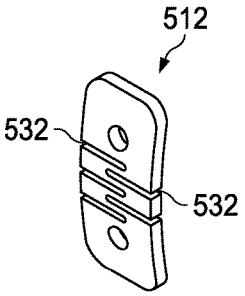
FIG. 5C depicts an enlarged view of a retainer associated with the external slip of FIG. 5A.

Referring to FIGS. 5A, 5B, and 5C, following positioning of the wedge 209 into engagement with the external slip 205, the external slip 205 may be placed in the pre-set position as illustrated in these figures. In the pre-set position, the gap 466 is smaller than in the expanded installation position. The decrease in gap width is made possible by the installation of a retainer 512, which may be coupled to the first and second gap ends 472, 474 of the wall 414. The retainer 512 may be received by a recess 516 on the external surface 422 of the wall 414 so that the retainer 512 does not extend radially outward past the plurality of teeth 230. The retainer 512 may be coupled to the first and second gap ends 472, 474 of the wall 414 by pins 520 having a shear strength that prevents the pins 520 from breaking when the external slip 205 is placed in the set position. In the set position, the gap 466 may be larger than the gap 466 when the external slip 205 is in the pre-set position.

In the embodiment illustrated in FIGS. 5A-5C, the retainer 512 is a plate that includes curvature to match the curvature of the recess 516 of the external surface 422 of the wall 414. The retainer 512 may include a plurality of retainer slots 532 (see FIG. 5C) to allow expansion of the retainer 512 as the external slip 205 is placed in the set position. In some embodiments, the retainer may be a spring such as a coil spring. Whatever the shape or form of the retainer (plate, spring, or other device), the retainer 512 may include a spring constant that is approximately equal to or greater than a spring constant of the wall 414 based on the ability of the wall 414 to expand due to the presence of the expansion slots 430. In other words, if the spring constant of the retainer 512 is greater than the spring constant of the wall 414, then the expansion of the expansion slots 430 will be greater than the expansion of the installation slot 462 when the external slip 205 is placed in the set position.

In the set position, the external slip 205 is expanded by the engagement of the wedge 209 with the external slip 205 and the application of force to the external slip 205 by the wedge 209. This force application causes the external slip 205 to expand radially outward (i.e., in a direction away from the mandrel 203). As the external slip 205 expands, the space between the expansion slots 430 increases, and in some instances, the gap 466 of the installation slot 462 also increases from that of its prior pre-set position. The radially outward expansion of the external slip 205 allows the plurality of teeth 230 to engage the inner surface of a casing, or alternatively a liner, an uncased wellbore wall, or another surface to set the packer assembly 100 in the well. As the external slip 205 expands, the positioning and configuration of the expansion slots 430 and installation slot 462, and the use of the retainer 512, prevents the external slip 205 from breaking into multiple segments when being set. The retainer 512 also prevents a large gap from forming at the installation slot 462, which allows a more circumferentially uniform expansion of the external slip 205, thereby providing a more uniform grip between the external slip 205 and the gripped surface (e.g., casing, liner, wellbore wall, or other surface).

It is important for well operators to be able to easily and cost effectively set, and in some cases retrieve, packers within a wellbore. The present disclosure describes systems, assemblies, and methods for setting and retrieving a packer assembly that includes improved external slips. The packer assemblies and external slips described herein improve the ability to run the packer to a setting depth. The retainer in conjunction with the slip acts as an anti-preset feature that prevents the slip from pre-maturely expanding due to trash or fluid flow in the well pushing either the slip itself or the wedge underneath the slip. In addition to the embodiments described above, many examples of specific combinations are within the scope of the disclosure, some of which are detailed below.

EXAMPLE 1

An external slip comprising:

a slip body comprising a wall having internal and external surfaces, the internal surface having a ramp portion configured to engage a complimentary surface of a wedge;

a plurality of teeth disposed on the external surface of the wall of the slip body;

a plurality of expansion slots extending through a thickness of the wall, at least one of the plurality of expansion slots extending from a first end of the wall toward a second end of the wall but not reaching the second end; at least another of the plurality of expansion slots extending from the second end of the wall toward the first end of the wall but not reaching the first end of the wall;

an installation slot extending through a thickness of the wall along a length of the wall from the first end to the second end, the installation slot defining a gap between first and second gap ends of the wall; and a retainer coupled to the first and second gap ends of the wall.

EXAMPLE 2

The external slip of example 1, wherein each of the plurality of expansion slots are parallel to another of the plurality of expansion slots.

EXAMPLE 3

The external slip of examples 1 or 2, wherein each of the plurality of expansion slots are parallel to a longitudinal axis of the slip body.

EXAMPLE 4

The external slip of any of examples 1-3, wherein the positioning of each of the plurality of expansion slots alternates such that any adjacent expansion slots do not extend from a same end of the first and second ends.

EXAMPLE 5

The external slip of any of examples 1-4, wherein the wall of the slip body is substantially cylindrical and the plurality of expansion slots are circumferentially spaced apart evenly.

EXAMPLE 6

The external slip of any of examples 1-5 further comprising:

a recess on the external surface of the wall to receive the retainer such that the retainer does not extend radially outward past the plurality of teeth.

EXAMPLE 7

The external slip of any of examples 1-6, wherein the retainer is coupled to the first and second gap ends of the wall by pins having a shear strength that prevents the pins from breaking when the external slip is placed in a set position.

EXAMPLE 8

The external slip of any of examples 1-7, wherein the retainer is a plate.

EXAMPLE 9

The external slip of any of examples 1-8, wherein the retainer includes a plurality of retainer slots to allow expansion of the retainer as the external slip is placed in a set position.

EXAMPLE 10

The external slip of any of examples 1-7, wherein the retainer is a spring.

EXAMPLE 11

The external slip of any of examples 1-10, wherein the retainer includes a spring constant that is approximately equal to a spring constant of the wall.

EXAMPLE 12

A method comprising:

positioning a slip in a well, the slip having a wall with a plurality of expansion slots, the slip having an installation slot extending through a thickness of the wall along the length of the wall from a first end of the wall to a second end of the wall;

expanding the slip such that a gap created by each of the plurality of expansion slots increases but does not permit the slip to break into multiple segments; and retaining the slip such that a gap created by the installation slot does not increase or increases less than or equal to a selected amount.

EXAMPLE 13

The method of example 12, further comprising:

contracting the expanded slip; and retrieving the slip from the well.

EXAMPLE 14

The method of examples 12 or 13, wherein the gap created by each of plurality of expansion slots increases by an equal amount.

EXAMPLE 15

A packer assembly capable of being disposed in a bore in a subterranean formation, the packer assembly comprising:

a slip having a wall with internal and external surfaces and a plurality of teeth disposed on the external surface, the slip having a plurality of expansion slots each extending through a thickness of the wall but along only a portion of a length of the wall, the slip having an installation slot extending through a thickness of the wall along the length of the wall from a first end of the wall to a second end of the wall;

a retainer attached to the slip across a gap created by the installation slot; and a wedge capable of, in a set position, (i) engaging the internal surface of the slip; and (ii) transferring a force to the slip in a direction capable of expanding the slip radially outward.

EXAMPLE 16

The packer assembly of example 15, wherein:

each of the plurality of expansion slots are parallel to another of the plurality of expansion slots; and the positioning of each of the plurality of expansion slots alternates such that any adjacent expansion slots do not extend from a same end of the first and second ends of the wall.

EXAMPLE 17

The packer assembly of examples 15 or 16, wherein the retainer is a plate.

EXAMPLE 18

The packer assembly of any of examples 15-17, wherein the retainer includes a plurality of retainer slots to allow expansion of the retainer as the slip is expanded radially outward.

EXAMPLE 19

The packer assembly of examples 15 or 16, wherein the retainer is a spring.

EXAMPLE 20

The packer assembly of any of examples 15-19, wherein the retainer includes a spring constant that is approximately equal to or greater than a spring constant of the wall of the slip.

EXAMPLE 21

An external slip as shown and described herein.

EXAMPLE 22

A method of setting or releasing a packer or external slip as shown and described herein.

EXAMPLE 23

A packer assembly as shown and described herein.

It should be apparent from the foregoing that embodiments of an invention having significant advantages have been provided. While the embodiments are shown in only a few forms, the embodiments are not limited but are susceptible to various changes and modifications without departing from the spirit thereof.

We claim:

1. An external slip comprising:

a slip body comprising a wall having internal and external surfaces, the internal surface having a ramp portion;

a plurality of teeth disposed on the external surface of the wall of the slip body;

a plurality of expansion slots extending through a thickness of the wall, at least one of the plurality of expansion slots extending from a first end of the wall toward a second end of the wall but not reaching the second end; at least another of the plurality of expansion slots extending from the second end of the wall toward the first end of the wall but not reaching the first end of the wall;

an installation slot extending through a thickness of the wall along a length of the wall from the first end to the second end; and a retainer coupleable to the wall across the installation slot, the retainer including a retainer slot sized to allow expansion of the retainer as the external slip is placed in a set position.

2. The external slip of claim 1, wherein each of the plurality of expansion slots are parallel to another of the plurality of expansion slots.

3. The external slip of claim 1, wherein each of the plurality of expansion slots are parallel to a longitudinal axis of the slip body.

4. The external slip of claim 1, wherein the positioning of each of the plurality of expansion slots alternates such that any adjacent expansion slots do not extend from a same end of the first and second ends.

5. The external slip of claim 1, wherein the wall of the slip body is substantially cylindrical and the plurality of expansion slots are circumferentially spaced apart evenly.

6. The external slip of claim 1 further comprising:

a recess on the external surface of the wall to receive the retainer such that the retainer does not extend radially outward past the plurality of teeth.

7. The external slip of claim 1, wherein the retainer is coupleable to the wall by pins having a shear strength that prevents the pins from breaking when the external slip is placed in a set position.

8. The external slip of claim 1, wherein the retainer is a plate.

9. The external slip of claim 1, wherein the retainer is a spring.

10. The external slip of claim 1, wherein the retainer includes a spring constant that is equal to or greater than a spring constant of the wall.

11. A method comprising:

positioning a slip in a well, the slip having a wall with a plurality of expansion slots, the slip having an installation slot extending through a thickness of the wall along the length of the wall from a first end of the wall to a second end of the wall;

expanding the slip such that a gap created by each of the plurality of expansion slots increases but does not permit the slip to break into multiple segments; and retaining the slip via a retainer such that a gap created by the installation slot does not increase or increases less than or equal to a selected amount, the retainer including a retainer slot sized to allow expansion of the retainer as the external slip is placed in a set position.

12. The method of claim 11, further comprising:

contracting the expanded slip; and retrieving the slip from the well.

13. The method of claim 11, wherein the gap created by each of plurality of expansion slots increases by an equal amount.

14. A packer assembly capable of being disposed in a bore in a subterranean formation, the packer assembly comprising:

a slip having a wall with internal and external surfaces and a plurality of teeth disposed on the external surface, the slip having a plurality of expansion slots each extending through a thickness of the wall but along only a portion of a length of the wall, the slip having an installation slot extending through a thickness of the wall along the length of the wall from a first end of the wall to a second end of the wall;

a retainer attached to the slip across a gap created by the installation slot, the retainer including a retainer slot sized to allow expansion of the retainer as the external slip is placed in a set position; and a wedge capable of, in a set position, (i) engaging the internal surface of the slip; and (ii) transferring a force to the slip in a direction capable of expanding the slip radially outward.

15. The packer assembly of claim 14, wherein:

each of the plurality of expansion slots are parallel to another of the plurality of expansion slots; and the positioning of each of the plurality of expansion slots alternates such that any adjacent expansion slots do not extend from a same end of the first and second ends of the wall.

16. The packer assembly of claim 14, wherein the retainer is a plate.

17. The packer assembly of claim 14, wherein the retainer is a spring.

18. The packer assembly of claim 14, wherein the retainer includes a spring constant that is equal to a spring constant of the wall of the slip.

* * * * *